US011891753B2

(12) United States Patent
Yoda et al.

(10) Patent No.: US 11,891,753 B2
(45) Date of Patent: Feb. 6, 2024

(54) FIBER STRUCTURE MANUFACTURING APPARATUS, METHOD OF MANUFACTURING FIBER STRUCTURE, AND FIBER STRUCTURE

(71) Applicant: SEIKO EPSON CORPORATION, Tokyo (JP)

(72) Inventors: Kaneo Yoda, Nagano (JP); Yoshiyuki Nagai, Nagano (JP); Yoichi Miyasaka, Nagano (JP); Nobutaka Urano, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 324 days.

(21) Appl. No.: 17/325,275

(22) Filed: May 20, 2021

(65) Prior Publication Data

US 2021/0363688 A1 Nov. 25, 2021

(30) Foreign Application Priority Data

May 22, 2020 (JP) ..... 2020-089396

(51) Int. Cl.

| | |
|---|---|
| ***D04H 1/60*** | (2006.01) |
| ***D04H 1/732*** | (2012.01) |
| ***D06M 10/00*** | (2006.01) |
| ***D06H 7/02*** | (2006.01) |

(52) U.S. Cl.

CPC ..... *D06M 10/00* (2013.01); *D04H 1/60* (2013.01); *D04H 1/732* (2013.01); *D06H 7/02* (2013.01)

(58) Field of Classification Search

CPC ..... D04H 1/60; D04H 1/732; D04H 1/736

See application file for complete search history.

(56) References Cited

U.S. PATENT DOCUMENTS

| | | | |
|---|---|---|---|
| 2017/0081794 | A1 | 3/2017 | Yamagami et al. |
| 2017/0152615 | A1 | 6/2017 | Jang et al. |
| 2017/0314173 | A1 | 11/2017 | Yamagami et al. |
| 2018/0334765 | A1 | 11/2018 | Yamagami et al. |

FOREIGN PATENT DOCUMENTS

| | | | |
|---|---|---|---|
| CN | 106164937 | A | 11/2016 |
| CN | 106808773 | A | 6/2017 |
| JP | H07-026451 | A | 1/1995 |
| JP | 2011-149106 | A | 8/2011 |
| JP | 2015-160409 | A | 9/2015 |

*Primary Examiner* — Mary Lynn F Theisen

(74) *Attorney, Agent, or Firm* — Global IP Counselors, LLP

(57) ABSTRACT

A fiber structure manufacturing apparatus including: an accumulation portion that accumulates a material containing a resin and a fiber in air to generate a fiber web; a transport portion that transports the generated fiber web in a transport direction; and a heating and pressurizing portion that pressurizes the transported fiber web with a heated lower flat plate and an upper flat plate to melt the resin, in which a liquid absorbent having a first region where pressurization by the heating and pressurizing portion is performed the predetermined number of times and a second region where the pressurization is performed more than a predetermined number of times is formed by alternately repeating transport at a predetermined pitch shorter than a length of the flat plate in the transport direction by the transport portion and the pressurization.

6 Claims, 9 Drawing Sheets

FIBER STRUCTURE MANUFACTURING APPARATUS, METHOD OF MANUFACTURING FIBER STRUCTURE, AND FIBER STRUCTURE

The present application is based on, and claims priority from JP Application Serial Number 2020-089396, filed May 22, 2020, the disclosure of which is hereby incorporated by reference herein in its entirety.

BACKGROUND

1. Technical Field

The present disclosure relates to a fiber structure manufacturing apparatus, a method of manufacturing a fiber structure, and the fiber structure.

2. Related Art

JP-A-2015-160409 describes a fiber structure manufacturing apparatus as a sheet manufacturing apparatus including a defibration portion that defibrates a product to be defibrated containing a fiber in the air, a supply portion that supplies an additive containing a resin to a defibrated product subjected to be defibrated, an accumulation portion in which these defibrated products and the additive are accumulated, and a heating portion that heats an accumulated web by interposing the accumulated web with a flat plate-shaped press. According to the manufacturing apparatus, since the web accumulated in the accumulation portion is interposed and heated by the flat plate-shaped press, the web fiber and the resin are not crushed in a unidirectional direction, and a non-anisotropic sheet can be formed as a fiber structure.

However, in the manufacturing apparatus described in JP-A-2015-160409, in order to reduce the size of the apparatus, it was necessary to limit the length of the flat plate-shaped press to an allowable length or less, and to manufacture the product by alternately repeating the pressing process and the web transport. In this case, depending on the variation in the transport accuracy and the transport specifications to be set, a region that is not pressed may occur at the seam of the pressing process by the flat plate-shaped press. As a result, the manufactured fiber structure has a problem that, for example, a strength defect portion may occur.

SUMMARY

According to an aspect of the present disclosure, there is provided a fiber structure manufacturing apparatus including: an accumulation portion that accumulates a material containing a resin and a fiber in air to generate a fiber web; a transport portion that transports the generated fiber web in a transport direction; and a heating and pressurizing portion that pressurizes the transported fiber web with a heated flat plate to melt the resin, in which a fiber structure having a first region where pressurization by the heating and pressurizing portion is performed the predetermined number of times and a second region where the pressurization is performed more than a predetermined number of times is formed by alternately repeating transport at a predetermined pitch shorter than a length of the flat plate in the transport direction by the transport portion and the pressurization.

According to an aspect of the present disclosure, there is provided a method of manufacturing a fiber structure including: an accumulation step of accumulating a material containing a resin and a fiber in air to generate a fiber web; a transport step of transporting the generated fiber web in a transport direction; and a heating and pressurizing step of pressurizing the transported fiber web with a heated flat plate to melt the resin, in which a fiber structure having a first region where pressurization by the heating and pressurizing portion is performed the predetermined number of times and a second region where the pressurization is performed more than a predetermined number of times is formed by alternately repeating transport at a predetermined pitch shorter than a length of the flat plate in the transport direction by a transport step and the pressurization by a heating and pressurizing step.

According to an aspect of the present disclosure, there is provided a fiber structure having main surfaces located in a front-to-back relationship and extending along the main surface, the fiber structure including: fibers: and a resin that bonds the fibers over an entire main surface in an extending direction of the main surface, in which a region having a high hardness due to a molten state of the resin when bonding the fibers is included in a plane of the main surface.

DESCRIPTION OF EXEMPLARY EMBODIMENTS

Hereinafter, embodiments of the present disclosure will be described with reference to the drawings.

Figure 1:
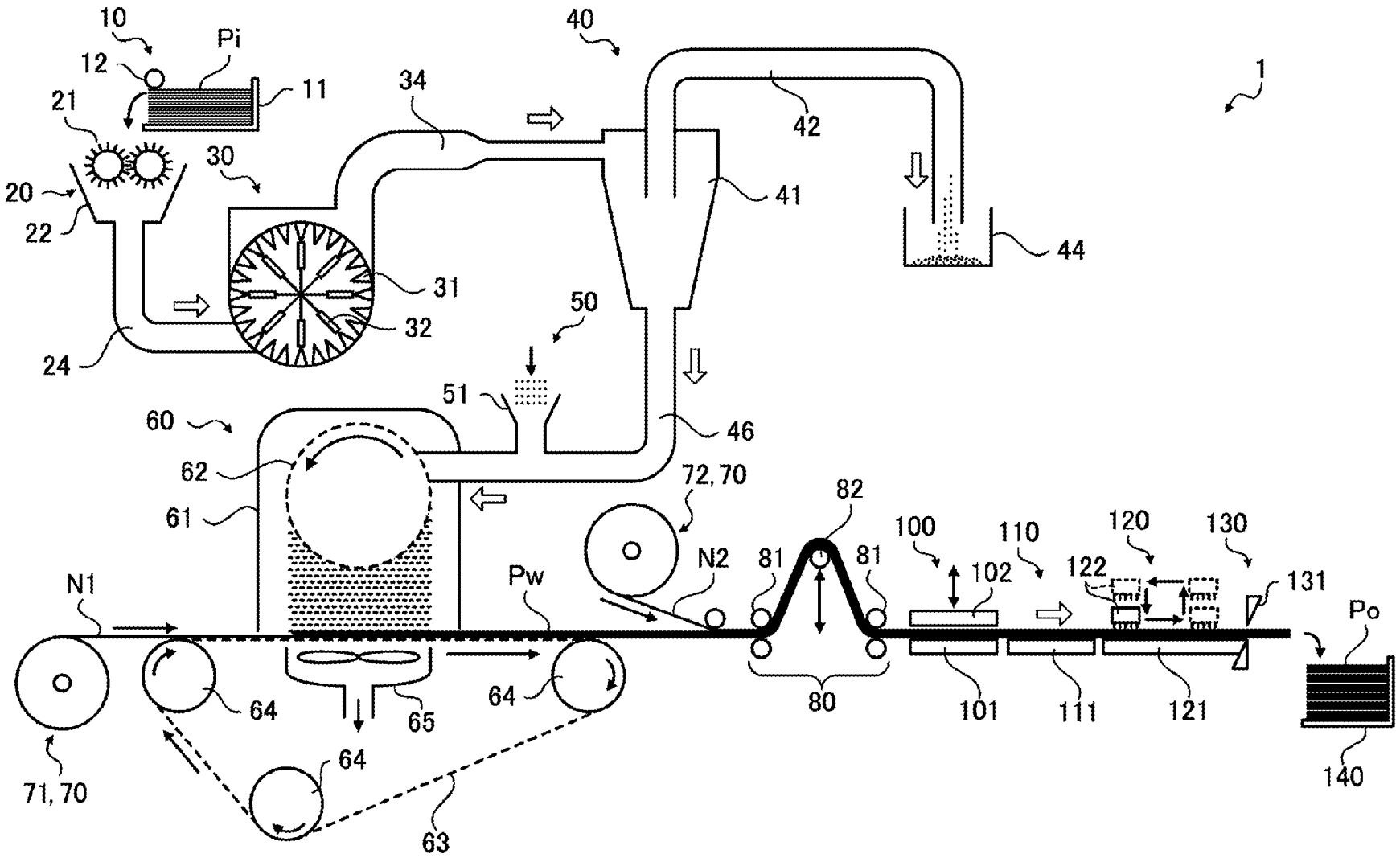
FIG. 1 is a schematic view illustrating an overall configuration of a fiber structure manufacturing apparatus according to an embodiment.

FIG. 1 is a schematic view illustrating a schematic configuration of a fiber structure manufacturing apparatus 1 according to an embodiment of the present disclosure.

The fiber structure manufacturing apparatus 1 is an apparatus that uses a recycled material such as a waste paper generated in the office as a main raw material and regenerates the recycled material as a new fiber structure by a dry method that uses as little water as possible. Here, as the fiber structure to be manufactured, for example, a liquid absorbent Po capable of absorbing oil or water will be described as an example. The main raw material may be any one containing cellulose fibers, and wood or the like can be used in addition to paper.

The manufactured fiber structure can be configured not only as such a liquid absorbent Po but also as a sound absorbing material that absorbs sound or a cushioning material in packaging. By disposing the fiber structure as the sound absorbing material inside various home appliances such as an ink jet printer, it is possible to suppress an operating noise to the outside of the device. In addition, the fiber structure can be used not only for home appliances but also as various building materials or as a sound absorbing material disposed in a concert hall or the like for sound adjustment.

The fiber structure manufacturing apparatus 1 includes a raw material input portion 10, a coarse crushing portion 20, a defibration portion 30, a classification portion 40, an additive input portion 50, an accumulation portion 60, a sheet supply portion 70, a buffer portion 80, a heating and pressurizing portion 100, a cooling portion 110, a transport portion 120, a cutting portion 130, an accommodation portion 140, and the like. In addition, the coarse crushing portion 20 and the defibration portion 30 are coupled to by a transport pipe 24, the defibration portion 30 and the classification portion 40 are coupled by a transport pipe 34, and the classification portion 40 and the accumulation portion 60 are coupled to by a transport pipe 46.

The raw material input portion 10 includes a waste paper tray 11, a supply roller 12, and the like. A waste paper Pi mounted on the waste paper tray 11 is picked up one by one by the supply roller 12 and put into the coarse crushing portion 20. The raw material input portion 10 is an example when the main raw material is, for example, waste paper such as A4 size copy paper discharged in the office.

The coarse crushing portion 20 includes a pair of coarse crushing blades 21 and a hopper 22 that mesh with each other and drive to rotate. The coarse crushing portion 20 divides the charged waste paper Pi into pieces of paper having a size of several centimeters square by the coarse crushing blade 21, and supplies the waste paper Pi to the defibration portion 30 via the transport pipe 24.

The fiber structure manufacturing apparatus 1 may be configured to supply the divided piece of paper as raw materials from the hopper 22 without providing the raw material input portion 10 and the coarse crushing blade 21.

The defibration portion 30 includes a stator 31, a rotor 32, and the like. The piece of paper guided into the defibration portion 30 via the transport pipe 24 is defibrated between the rotating rotor 32 and the stator 31. In a defibration step in the defibration portion 30, the piece of paper is defibrated until the piece of paper loses the shape and becomes fibrous. At this time, at least a portion of ink, toner, and various additive materials adhering to the piece of paper is separated as separated particles having a size of several tens of μm or less.

The defibrated fibers and the separated particles are transported from the transport pipe 34 to the classification portion 40 by the air flow generated by the rotor 32.

The classification portion 40 includes a cyclone 41, a discharge pipe 42, a discharge container 44, and the like. The cyclone 41 is an airflow type classifier, and has a function of classifying the contents by the balance between the centrifugal force due to the swirling airflow and the drag force of the air.

The fibers and the separated particles guided to the cyclone 41 via the transport pipe 34 are classified into fibers and separated particles by the cyclone 41. The classified fibers are transported to the accumulation portion 60 via the transport pipe 46. In addition, the classified separated particles are discharged to the discharge container 44 via the discharge pipe 42.

Since the separated particles containing ink and toner are removed by a classification step by the classification portion 40, the fibers transported to the accumulation portion 60 are deinked fibers. The classification referred to here does not mean that the fibers and the separated particles are completely separated, and the deinking does not mean that the fibers do not contain ink or toner at all.

The additive input portion 50 includes a hopper 51 that communicates with the transport pipe 46. Various additives whose input amount is adjusted are input from the hopper 51 and mixed with the fibers transported from the cyclone 41.

As an additive, in addition to a fibrous resin for forming bonds between fibers by melting and giving the liquid absorbent Po to be manufactured an appropriate strength, a flame retardant for enhancing the fire resistance performance of the liquid absorbent Po is used.

The accumulation portion 60 includes a dispersion mechanism for substantially uniformly dispersing the defibrated fibers in the air as air together with the additive, and an accumulation mechanism for accumulating the fibers and the additive dispersed thereby.

The dispersion mechanism includes a housing 61, a forming drum 62 covered with the housing 61, and the like. The forming drum 62 is a cylindrical body rotatably formed, and a plurality of small holes are provided on the rotating side surface of the cylindrical body.

The fiber to which the additive is added is guided from the transport pipe 46 and put into the inside of the rotating forming drum 62. The forming drum 62 is driven to rotate, and the contents of the forming drum 62, that is, the fibers to which the additive is added are discharged to the outside of the forming drum 62 through the small holes, so that the dispersed fibers descend toward the accumulation mechanism provided below the forming drum 62 while the additives are uniformly mixed.

The accumulation mechanism is a mechanism for forming the fibers accumulated from the dispersion mechanism as long accumulated products, and includes a mesh belt 63, a tension roller 64, a suction device 65, and the like.

The mesh belt 63 is an endless mesh-shaped belt that is stretched and rotated by the tension roller 64, and constitutes a accumulation region where the fibers are accumulated in the air vertically below the forming drum 62.

The suction device 65 is provided below the accumulation region formed by the mesh belt 63, and by sucking air through the mesh belt 63, the fibers and additives dispersed in the air can be accumulated on the mesh belt 63.

While driving to rotate the mesh belt 63, a long fiber web Pw is formed by sucking and accumulating the fibers dispersed in the air on the mesh belt 63, specifically, onto a first sheet N1 described later supplied onto the mesh belt 63, by the suction device 65.

That is, the accumulation portion 60 includes the dispersion mechanism and the accumulation mechanism described above, and accumulates a material containing a resin and a fiber in the air to generate the fiber web Pw. In addition, in this accumulation step in the accumulation portion 60, the material containing the resin and the fiber is accumulated in the air to generate the fiber web Pw.

The sheet supply portion 70 includes a first sheet supply portion 71 that supplies the first sheet N1 and a second sheet supply portion 72 that supplies a second sheet N2.

The first sheet N1 and the second sheet N2 are long sheets for laminating the fiber web Pw formed by the accumulation portion 60. The first sheet N1 is a sheet that forms a bottom surface serving as a base on which the fibers are accumulated when the fiber web Pw is formed, and the second sheet N2 is a sheet that laminates the formed fiber web Pw from the upper surface side thereof.

That is, the first sheet supply portion 71 is provided on the upstream of the accumulation region formed by the mesh belt 63 in the direction where the formed fiber web Pw is transported, and feeds the first sheet N1 to the accumulation region and in the downstream direction in accordance with the movement of the mesh belt 63. In addition, the second sheet supply portion 72 is provided on the downstream of the accumulation region on the upper side of the fiber web Pw to be transported, and laminates the second sheet N2 on the upper surface of the fiber web Pw while feeding out in the direction of the buffer portion 80 provided on the further downstream.

The first sheet N1 needs to have air permeability in order to accumulate the fibers dispersed in the air on the first sheet N1 by the suction of the suction device 65. In addition, since the first sheet N1 and the second sheet N2 are manufactured as liquid absorbents Po, the first sheet N1 and the second sheet N2 need to have liquid permeability.

The fiber web Pw does not necessarily have to be laminated by the first sheet N1 and the second sheet N2. That is, for example, the accumulation portion 60 may have a configuration in which the fibers are accumulated on the first sheet N1 by using only the first sheet N1, or may have a configuration in which the fibers are accumulated on the upper surface of the mesh belt 63 and the accumulated fibers are transported downstream while being separated from the mesh belt 63 to be formed as a continuous fiber web Pw without using the first sheet N1. In this case, the accumulation portion 60 needs to be provided with a separation mechanism that separates the accumulated fibers from the mesh belt 63 and a transport mechanism that transports the separated fiber web Pw to the heating and pressurizing portion 100 without breaking the fiber web Pw.

In addition, the accumulation portion 60 does not need to be provided with the second sheet supply portion 72 when only the first sheet N1 is used, and does not need to be provided with the first sheet supply portion 71 when the first sheet N1 is not used.

In any configuration, since the mesh belt 63 may be entangled with the fibers sucked by the suction device 65, it is preferable that the mesh belt 63 is provided with a cleaning mechanism that removes the entangled fibers.

Since the fiber web Pw after the heating and pressurizing portion 100 provided on the downstream in a transport path of the formed fiber web Pw is transported intermittently instead of continuously at a constant speed, the buffer portion 80 is a buffer mechanism that stores the fiber web Pw fed out from the accumulation portion 60 when the transport of the fiber web Pw after the heating and pressurizing portion 100 is stopped.

The buffer portion 80 is provided with two roller pairs 81 that nip from above and below the fiber web Pw to be transported and rotate as the fiber web Pw moves, and a roller 82 whose axial position is movably supported up and down and rotates as the fiber web Pw moves. The two roller pairs 81 are provided with fixed axial positions front and rear the fiber web Pw in the transport direction, and the roller 82 supports the fiber web Pw from below in a space between the two roller pairs 81 and moves up and down in accordance with the transport of the fiber web Pw. The vertical movement of the roller 82 is preferably controlled so that the tension applied to the fiber web Pw does not fluctuate significantly between the continuous transport of the fiber web Pw by the rotation of the mesh belt 63 and the intermittent transport of the fiber web Pw after the heating and pressurizing portion 100.

The transport direction is a moving direction of the fiber web Pw in the transport path until the fiber web Pw formed by the accumulation portion 60 is accommodated in the accommodation portion 140 through the buffer portion 80, the heating and pressurizing portion 100, the cooling portion 110, the transport portion 120, and the cutting portion 130.

The heating and pressurizing portion 100 is provided on the downstream of the buffer portion 80, and pressurizes the transported fiber web Pw with flat plates heated from above and below the fiber web Pw to melt the fibrous resin added as an additive. That is, in this heating and pressurizing step in the heating and pressurizing portion 100, the transported fiber web Pw is pressurized with a heated flat plate to melt the resin.

The heating and pressurizing portion 100 includes a lower flat plate 101 and an upper flat plate 102 disposed to face each other as flat plates to be heated and pressed. The length of the lower flat plate 101 and the upper flat plate 102 in the width direction, that is, the length in the direction intersecting the transport direction of the fiber web Pw is longer than the width of the fiber web Pw. In addition, each of the flat plates is provided with a heater so that the flat plate can be heated to a desired temperature. The lower flat plate 101 and the upper flat plate 102 move relatively using a press mechanism such as a hydraulic press, an air press, or a mechanical press, and the fiber web Pw is interposed between the lower flat plate 101 and the upper flat plate 102 and is heated and pressurized at a predetermined temperature and a predetermined pressure. Therefore, the resin contained in the fiber web Pw can be melted and entangled with the fibers. In addition, by pressurizing the fiber web Pw between the lower flat plate 101 and the upper flat plate 102, the fiber web Pw is formed with main surfaces located in a front-to-back relationship.

The cooling portion 110 is provided on the downstream of the heating and pressurizing portion 100, and is heated and pressurized by the heating and pressurizing portion 100 to cool the fiber web Pw transported to the cooling portion 110. The cooling portion 110 is provided with, for example, a heat sink plate 111 that is in sliding contact with the bottom surface of the fiber web Pw. The heat sink plate 111 dissipates heat absorbed from the bottom surface of the fiber web Pw into the air. The cooling portion 110 may be provided with a blower portion that enhances the heat dissipation effect of heat dissipating into the air from the upper surface of the fiber web Pw or the heat sink plate 111.

The resin melted and entangled with the fibers is cooled and solidified to bond the accumulated fibers. In addition, when laminating the first sheet N1 and the second sheet N2, the resin is melted, cooled, and solidified, so that the first sheet N1 is adhered to the bottom surface of the fiber web Pw and the second sheet N2 is adhered to the upper surface of the fiber web Pw, each forming the main surface of the fiber web Pw.

Through this cooling step in the cooling portion 110, the resin melted and entangled with the fibers is cooled and solidified, that is, the resin bonds the fibers, and the fiber web Pw is an aspect as a fiber structure having main surfaces located in a front-to-back relationship.

The transport portion 120 is provided on the downstream of the cooling portion 110, and transports the fiber web Pw in the transport direction by applying a transport force to the fiber web Pw. That is, in this transport step by the transport portion 120, the generated fiber web Pw is transported in the transport direction.

The transport portion 120 includes a table 121, a transport arm 122, and the like.

The table 121 is a flat plate-shaped guide table that extends in the transport direction of the fiber web Pw and supports the fiber web Pw to be transported from below.

The transport arm 122 grips the fiber web Pw with the table 121 and moves the fiber web Pw in the transport direction to apply a transport force to the fiber web Pw, so that the fiber web Pw can be moved while being in sliding contact with the table 121. The transport arm 122 includes a plurality of spike pins on the surface that abuts on the fiber web Pw, and when gripping the fiber web Pw with the table 121, presses the spike pins so as to pierce the upper surface of the fiber web Pw. The transport arm 122 can transport the fiber web Pw by a predetermined pitch by moving the spike pin by a predetermined pitch in the transport direction in a state where the spike pin is pierced into the upper surface of the fiber web Pw. When the transport of the predetermined pitch is completed, the transport arm 122 releases the grip with the table 121, that is, the spike pin moves in the direction away from the upper surface of the fiber web Pw, and then returns to the position where the fiber web Pw is gripped with the table 121, and again grips the fiber web Pw with the table 121.

The transport portion 120 starts transporting and transports at a predetermined pitch during the period when the heating and pressurizing portion 100 completes the heating and pressurizing and the lower flat plate 101 and the upper flat plate 102 are open, and performs operations from opening of the grip to re-gripping during the period when the heating and pressurizing portion 100 performs the heating and pressurizing. By repeating this operation, the fiber web Pw is heated and pressurized, and is intermittently transported while being cooled. That is, the fiber structure manufacturing apparatus 1 alternately repeats the transport by the transport portion 120 at a predetermined pitch and the pressurization by the heating and pressurizing portion 100.

The fiber web Pw fed out from the transport portion 120 reaches the cutting portion 130 provided on the downstream of the transport portion 120.

The cutting portion 130 is provided with a cutter 131 that cuts the fiber web Pw in a direction intersecting the transport direction of the fiber web Pw. As the cutter 131, various forms such as an ultrasonic cutter, a rotary cutter, and a Thomson type cutter can be adopted.

In addition to the cutter 131 described above, the cutting portion 130 may be provided with a cutter that cuts the fiber web Pw in the transport direction of the fiber web Pw.

In the cutting portion 130, by providing the cutter 131 at a predetermined position, the fiber web Pw transported to the cutting portion 130 is cut at a predetermined position, that is, in this cutting step at the cutting portion 130, the fiber structure is cut to form a liquid absorbent Po as a fiber structure having a predetermined size and a predetermined shape. The liquid absorbent Po as the cut fiber structure is accommodated in the accommodation portion 140.

In the fiber structure manufacturing apparatus 1 having the basic configuration described above, the aspect of the liquid absorbent Po as the fiber structure to be formed can be various aspects depending on the specifications such as the size of the lower flat plate 101 and the upper flat plate 102 in the heating and pressurizing portion 100, the length of a predetermined pitch transported by the transport portion 120, and the cutting position at the cutting portion 130.

In the fiber structure manufacturing apparatus 1 of the present embodiment, a fiber structure having a first region P1 where pressurization is performed a predetermined number of times and a second region P2 where pressurization is performed more than a predetermined number of times is formed by alternately repeating the transport at a predetermined pitch shorter than the length W of the heated flat plate of the heating and pressurizing portion 100 in the transport direction by the transport portion 120 and the pressurization by the heating and pressurizing portion 100.

In addition, as a method of manufacturing a fiber structure of the present embodiment, the fiber structure having the first region P1 where pressurization is performed a predetermined number of times and the second region P2 where pressurization is performed more than a predetermined number of times is formed by alternately repeating the transport at a predetermined pitch shorter than the length W of the heated flat plate of the heating and pressurizing portion 100 in the transport direction by the transport step and the pressurization by the heating and pressurizing step.

The liquid absorbent Po manufactured by such a manufacturing method and the fiber structure manufacturing apparatus 1 has main surfaces located in a front-to-back relationship, is formed as a fiber structure extending along the main surface, and includes fibers and a resin that bonds the fibers over the entire extending direction of the main surface. In addition, the liquid absorbent Po includes the first region P1 formed by performing pressurization a predetermined number of times and the second region P2 formed by performing pressurization more than a predetermined number of times.

Since the second region P2 is heated and pressed more times by the heating and pressurizing portion 100 than that of the first region P1, the second region P2 is a region having high hardness due to the molten state of the resin when bonding the fibers.

The transport portion 120 is configured to perform transport by applying a transport force to the second region P2. That is, in the transport step by the transport portion 120, the transport force is applied to the second region P2. Specifically, in the transport portion 120, the transport arm 122 for gripping the fiber web Pw with the table 121 is provided at a position where the second region P2 is gripped when gripping the fiber web Pw. The transport arm 122 presses and grips the spike pin of the transport arm 122 so as to pierce the second region P2 of the fiber web Pw to perform transport.

The length W of the heating and pressurizing portion 100 in the transport direction of the heated flat plate is specifically the length of the region pressurized by the lower flat plate 101 and the upper flat plate 102 in the transport direction. In the present embodiment, the case where the lower flat plate 101 and the upper flat plate 102 have the same length in the transport direction of the lower flat plate 101 and the upper flat plate 102 are configured to interpose the fiber web Pw without deviation will be described. Therefore, the length W of the heating and pressurizing portion 100 in the transport direction of the heated flat plate is equal to the length of the lower flat plate 101 in the transport direction and the length of the upper flat plate 102 in the transport direction.

Hereinafter, specific examples of forming various aspects of the liquid absorbent Po will be described with reference to FIGS. 2 to 11.

In FIGS. 2 to 5, W and W1 to W3 illustrate the lengths of the heating and pressurizing portion 100 in the transport direction of the heated flat plate. In addition, L1 to L3 indicate the length of a predetermined pitch to be transported by the transport portion 120.

Example 1

Figure 2:
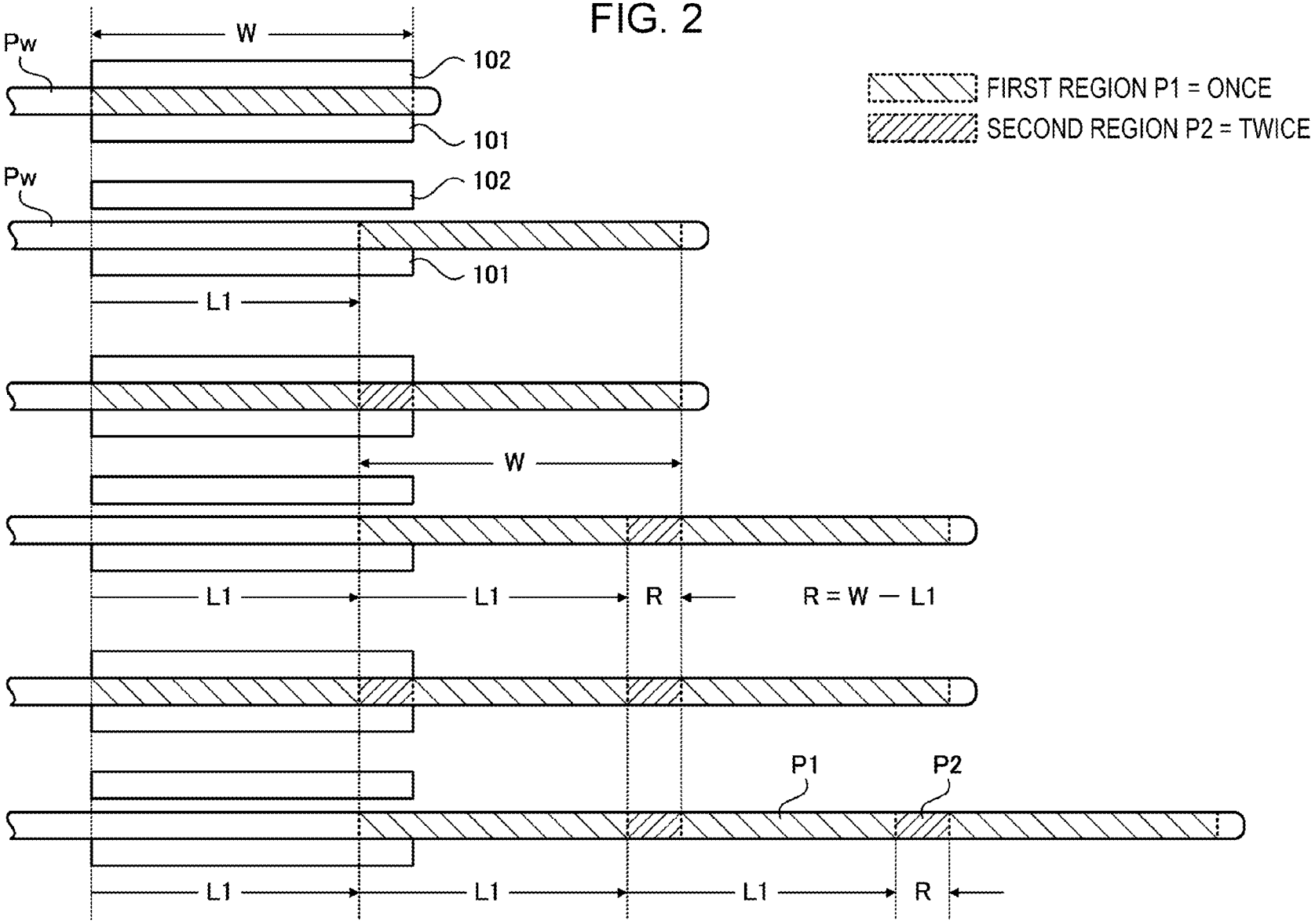
FIG. 2 is a schematic view illustrating an example of a flat plate size of a heating and pressurizing portion and a length of a predetermined pitch transported by a transport portion as Example 1.

As Example 1, FIG. 2 illustrates a state of the fiber web Pw when the fiber web Pw is manufactured by transporting the fiber web Pw at a pitch L1 of $L1<W<L1\times2$ at a length W of the heating and pressurizing portion 100 in the transport direction of the heated flat plate and a length L1 of a predetermined pitch transported by the transport portion 120. From the top of FIG. 2, the pressurization by the lower flat plate 101 and the upper flat plate 102 and the transport of the pitch L1 are alternately performed.

Since $L1<W$ and $W<L1\times2$, in the fiber web Pw, a first region P1 where pressurization is performed once as a predetermined number of times by the heating and pressurizing portion 100, and a second region P2 where pressurization is performed twice more than a predetermined number of times are formed except for a region at the tip end portion where pressurization is not performed by the heating and pressurizing portion 100. In addition, the length R of the second region P2 where pressurization is performed twice in the transport direction is $R=W-L1>0$.

Example 2

Figure 3:
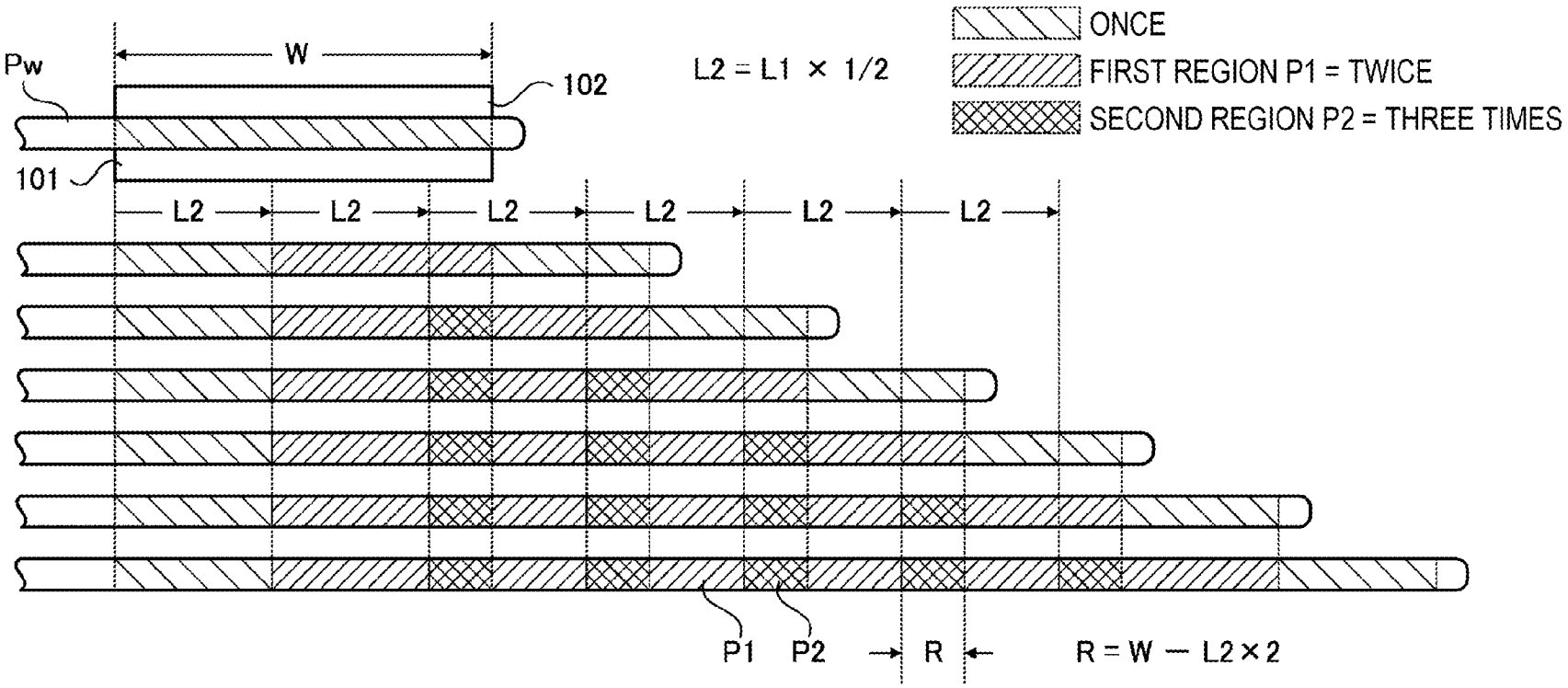
FIG. 3 is a schematic view illustrating an example of a flat plate size of a heating and pressurizing portion and a length of a predetermined pitch transported by a transport portion as Example 2.

As Example 2, FIG. 3 illustrates a state of the fiber web Pw when the fiber web Pw is manufactured by transporting the fiber web Pw at a pitch L2 of $L2\times2<W<L2\times3$ at a length W of the heating and pressurizing portion 100 in the transport direction of the heated flat plate and a length L2 of a predetermined pitch transported by the transport portion 120 The example of FIG. 3 illustrates a case where the transport is performed at a pitch L2, which is half the pitch L1, with respect to the pitch L1 of Example 1 illustrated in FIG. 2. FIG. 3 illustrates only the fiber web Pw sequentially pressurized and transported from the second time onward.

Since $L2\times2<W$ and $W<L2\times3$, in the fiber web Pw, a first region P1 where pressurization is performed twice as a predetermined number of times, and a second region P2 where pressurization is performed three times more than a predetermined number of times are formed except for a region of the tip end portion where pressurization is not performed by the heating and pressurizing portion 100 and pressurization is performed only once. In addition, the length R of the second region P2 where the pressurization is performed three times in the transport direction is $R=W-L2\times2>0$.

Example 3

Figure 4:
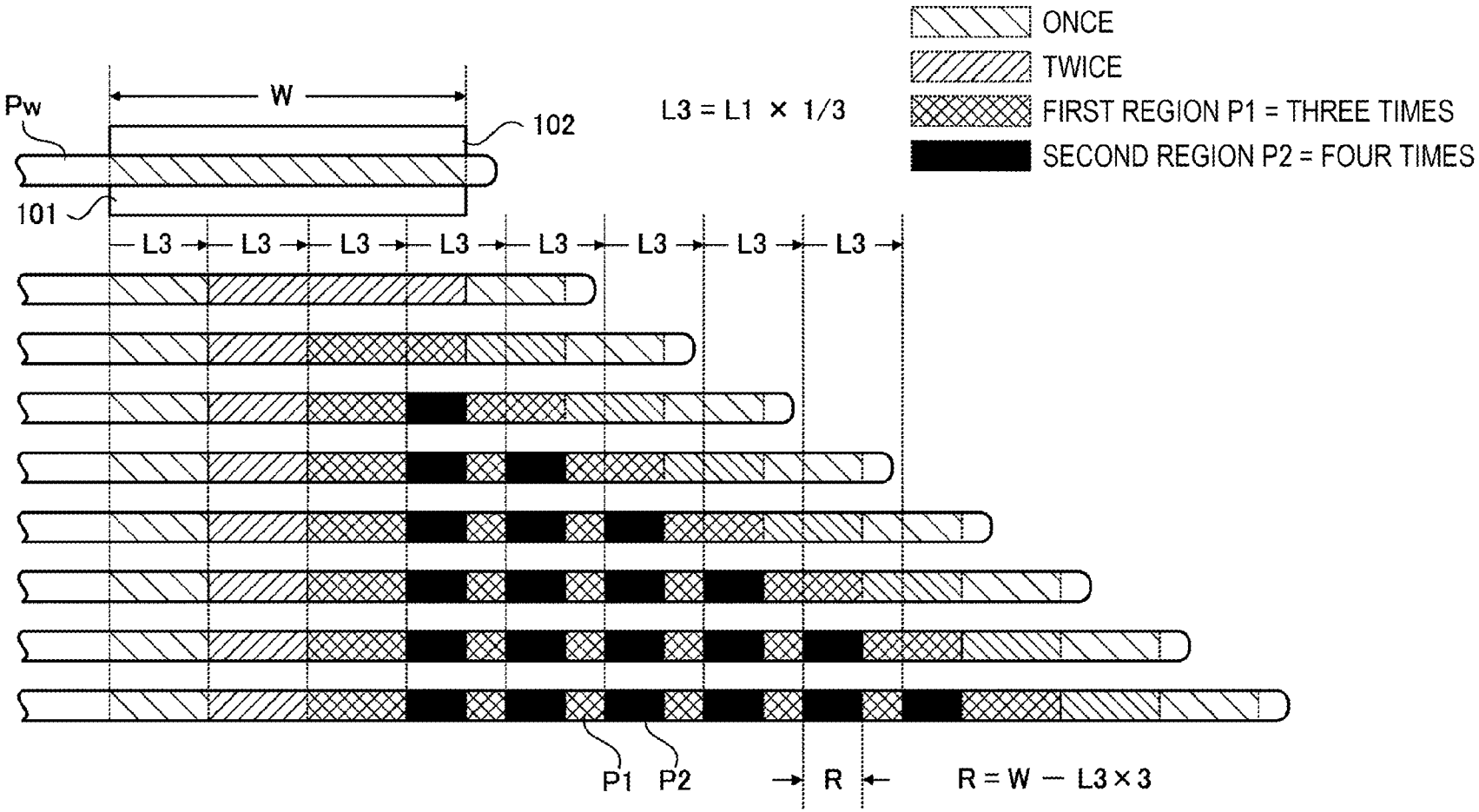
FIG. 4 is a schematic view illustrating an example of a flat plate size of a heating and pressurizing portion and a length of a predetermined pitch transported by a transport portion as Example 3.

As Example 3, FIG. 4 illustrates a state of the fiber web Pw when the fiber web Pw is manufactured by transporting the fiber web Pw at a pitch L3 of $L3\times3<W<L3\times4$ at a length W of the heating and pressurizing portion 100 in the transport direction of the heated flat plate and a length L3 of a predetermined pitch transported by the transport portion 120. The example of FIG. 4 illustrates a case where the transport is performed at a pitch L3, which is one third of the pitch L1, with respect to the pitch L1 of Example 1 illustrated in FIG. 2. FIG. 4 illustrates only the fiber web Pw sequentially pressurized and transported from the second time onward.

Since $L3\times3<W$ and $W<L3\times4$, in the fiber web Pw, a first region P1 where pressurization is performed three times as a predetermined number of times, and a second region P2 where pressurization is performed four times more than a predetermined number of times are formed except for a region of the tip end portion where pressurization is not performed by the heating and pressurizing portion 100 and pressurization is performed only up to two times. In addition, the length R of the second region P2 where pressurization is performed four times in the transport direction is $R=W-L3\times3>0$.

Example 4

In Examples 1 to 3, an example is described in which the length of a predetermined pitch transported by the transport portion 120 is changed with respect to the length W of the heating and pressurizing portion 100 in the transport direction of the heated flat plate. In the present example, the relationship between the length Wn of the heating and pressurizing portion 100 in the transport direction of the heated flat plate and the length Ln of a predetermined pitch transported by the transport portion 120 will be described as an example in which the length W of the heating and pressurizing portion 100 in the transport direction of the heated flat plate is shortened to 1/n in the same relationship in the case of Example 1, that is, in the relationship of $Ln<Wn<Ln\times2$. By shortening the length W of the heating and pressurizing portion 100 in the transport direction of the flat plate, the size of the fiber structure manufacturing apparatus 1 can be reduced.

Figure 5:
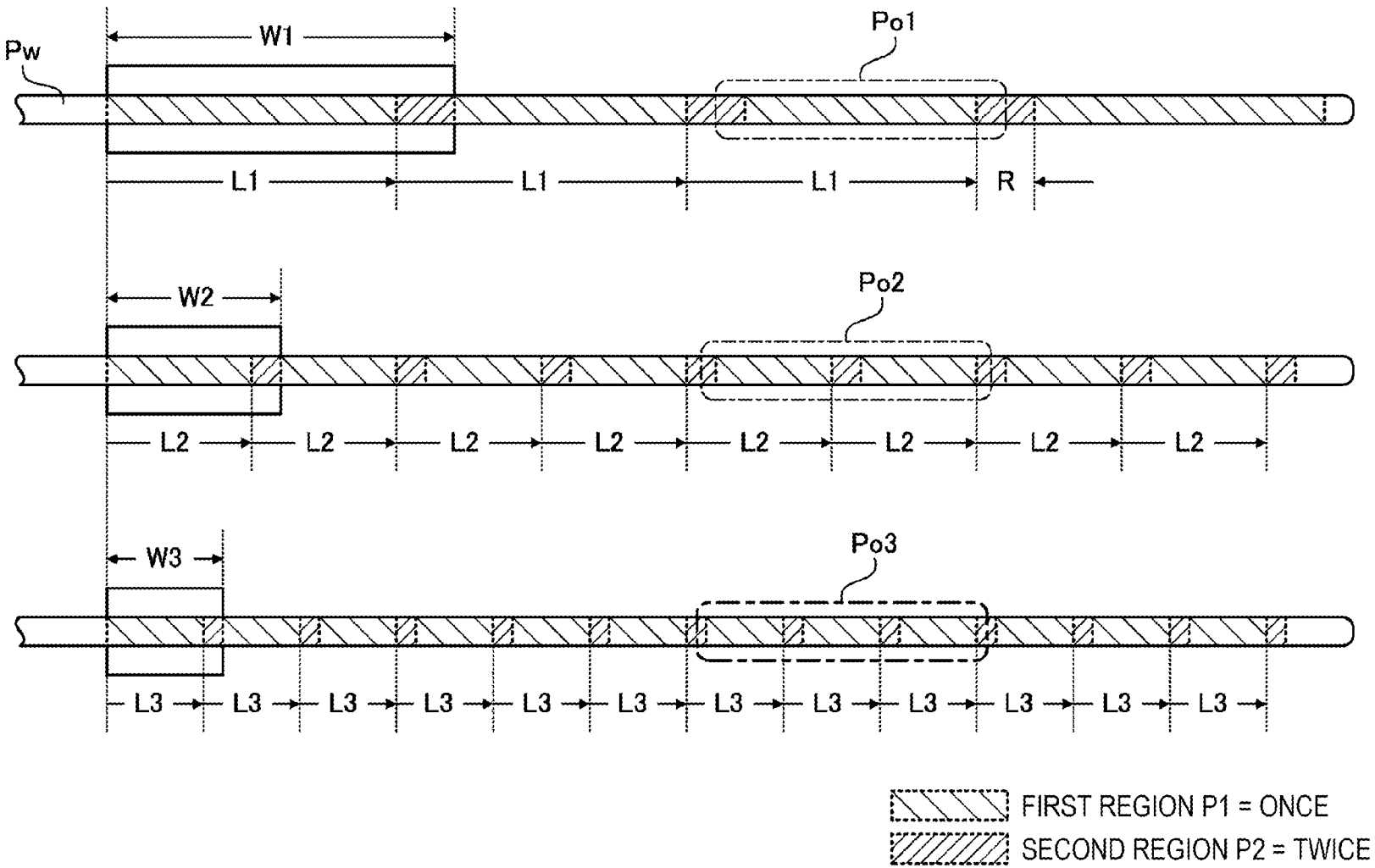
FIG. 5 is a schematic view illustrating an example in which a flat plate size of the heating and pressurizing portion is shortened as Example 4.

Here, n is a natural number, and FIG. 5 illustrates an example in the case of n=1, 2, and 3, specifically, W1, W2 which is one half of W1, and W3 which is one third of W1.

As illustrated in FIG. 5, since $Ln<Wn$ and $Wn<Ln\times2$, in the fiber web Pw, a first region P1 where pressurization is performed once as a predetermined number of times by the heating and pressurizing portion 100, and a second region P2 where pressurization is performed twice more than a predetermined number of times are formed except for a region at the tip end portion where pressurization is not performed by the heating and pressurizing portion 100. In addition, the length R of the second region P2 where pressurization is performed twice in the transport direction is $R=Wn-Ln>0$.

In addition, in FIG. 5, a region surrounded by the one-dot chain line is an example of an individual liquid absorbent Pon obtained by cutting. Even when the length W of the heating and pressurizing portion 100 in the transport direction of the flat plate is shortened, by increasing the number of pressurization by the heating and pressurizing portion 100 and the number of times of transporting by the transport portion 120, a liquid absorbent Pon having the same size can be obtained. As n is increased, the number of the second region P2 divided and formed inside the liquid absorbent Pon increases.

Example 5

Next, as Example 5, variations of the liquid absorbent Po due to the difference in the cutting position when cutting the fiber web Pw at the cutting portion 130 will be described.

Figure 6:
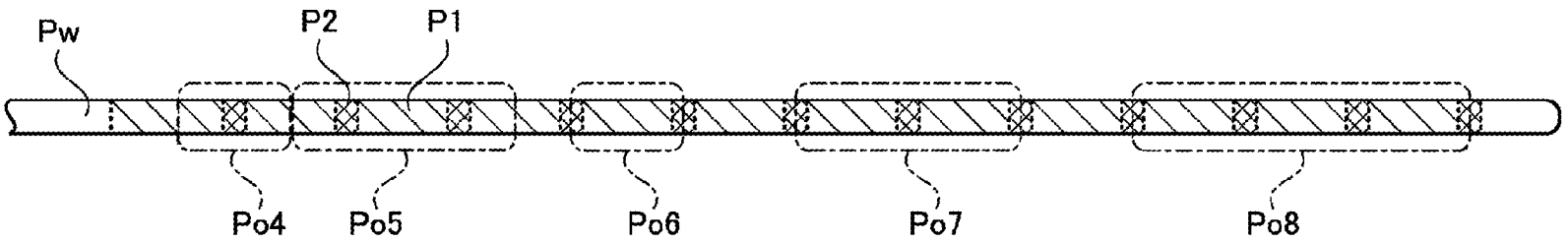
FIG. 6 is a schematic view illustrating a variation of a liquid absorbent due to a difference in a cutting position when cutting a fiber web at a cutting portion as Example 5.

A region surrounded by the one-dot chain line in FIG. 6 is a region that is an individual liquid absorbent Pon obtained by cutting. In FIG. 6, liquid absorbents Po4 to Po8 of different aspects are illustrated in one fiber web Pw, and in practice, one of these liquid absorbents is selected to continuously manufacture the liquid absorbent Pon of the same aspect.

In FIG. 6, the liquid absorbent Po4 and Po5 are examples of the liquid absorbent Po when the first region P1 is cut. That is, in the manufacturing of the liquid absorbent Po4 and Po5, the cutting portion 130 is set to cut the first region P1 as a cutting step.

In order to cut the first region P1, the second region P2, that is, the region having high hardness is provided between one end portion and the other end portion in the extending direction of the main surface.

Figure 7:
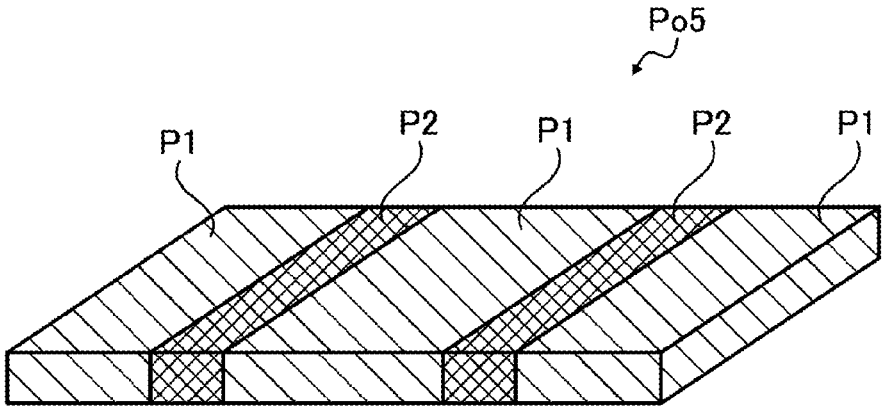
FIG. 7 is a perspective view of one example of a variation of the liquid absorbent of Example 5.

FIG. 7 illustrates a perspective view of the liquid absorbent Po5. Since the length in the width direction of the lower flat plate 101 and the upper flat plate 102, that is, the length in the direction intersecting the transport direction of the fiber web Pw, both are longer than the width of the fiber web Pw, as illustrated in FIG. 7, the second region P2, that is, the region having high hardness is provided across the main surface in a direction intersecting the transport direction in the manufacturing stage.

The liquid absorbents Po4 and Po5 have different positions of the first region P1 to be cut, and the liquid absorbent Po4 has one second region P2 crossing the main surface in the central region between both cut end surfaces. In addition, the liquid absorbent Po5 has two second regions P2 crossing the main surface in the central region between both cut end surfaces.

In addition, in FIG. 6, the liquid absorbent Po6 to Po8 are examples of the liquid absorbent Po when cutting the second region P2. That is, in the manufacturing of the liquid absorbent Po6 to Po8, the cutting portion 130 is set to cut the second region P2 as a cutting step.

Figure 8:
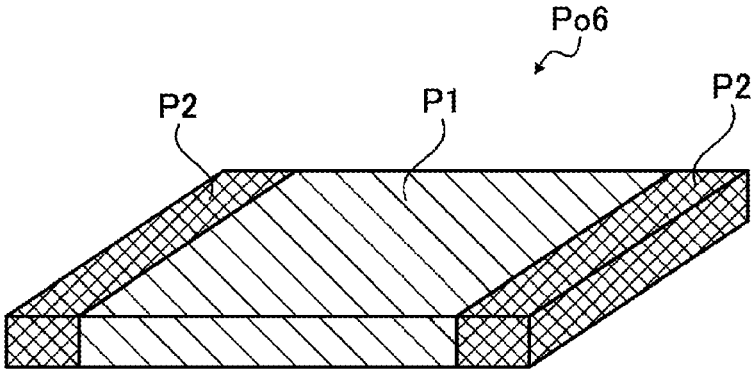
FIG. 8 is a perspective view of one example of a variation of the liquid absorbent of Example 5.

FIG. 8 illustrates a perspective view of the liquid absorbent Po6. Since the length in the width direction of the lower flat plate 101 and the upper flat plate 102, both are longer than the width of the fiber web Pw, as illustrated in FIG. 8, the second region P2, that is, the region having high hardness is provided across the main surface at the end portion of the main surface of the liquid absorbents Po6 to Po8 in the extending direction.

The liquid absorbents Po6 and Po8 have different positions of the second region P2 to be cut, and the liquid absorbent Po7 has one second region P2 crossing the main surface in the central region between both cut end surfaces. In addition, the liquid absorbent Po8 has two second regions P2 crossing the main surface in the region between both cut end surfaces.

The liquid absorbent Po may be folded.

Specifically, for example, the fiber structure manufacturing apparatus 1 is provided with a bending portion 150 for folding the liquid absorbent Po on the downstream of the cutting portion 130, and may be configured to bend the liquid absorbent Po at a predetermined position, fold the liquid absorbent Po, and then accommodate the liquid absorbent Po in the accommodation portion 140.

Figure 9:
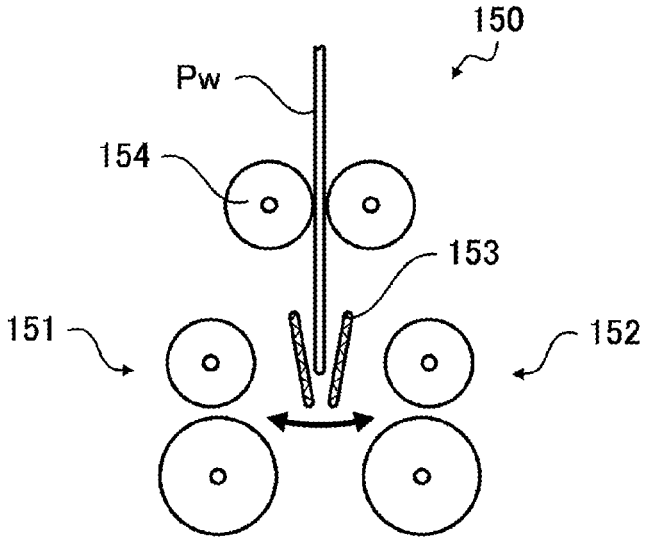
FIG. 9 is a schematic view illustrating a configuration of a bending portion.
Figure 10:
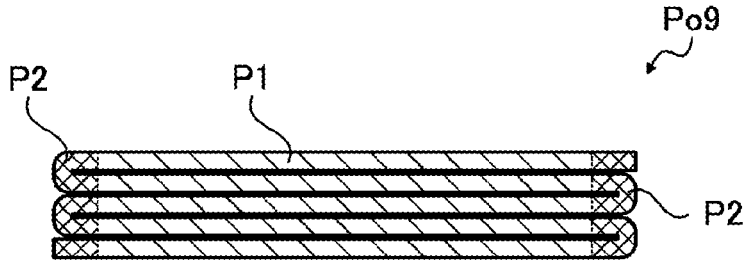
FIG. 10 is a schematic view illustrating an example of a liquid absorbent in a folded state as Example 6.

As illustrated in FIG. 9, the bending portion 150 includes a first folding roller pair 151, a second folding roller pair 152, a guide member 153, a feed roller pair 154, and the like. Each of the first folding roller pair 151 and the second folding roller pair 152 includes a drive roller and a pinch roller.

The fiber web Pw is inserted into the guide member 153 by the feed roller pair 154, and the guide member 153 rotates to alternately distribute the fiber web Pw in the direction of the first folding roller pair 151 and the direction of the second folding roller pair 152. The cutting tip end of the fiber web Pw or a bending region of the fiber web Pw is alternately inserted into the first folding roller pair 151 and the second folding roller pair 152, and the winding and discharging are performed by each of drive rollers. The fiber web Pw is bent by interposing the bending region of the fiber web Pw between the drive roller and a pinch roller. By alternately bending the first folding roller pair 151 and the second folding roller pair 152, mountain folds and valley folds are performed on the fiber web Pw.

The bending position of the fiber web Pw can be controlled by the timing of driving the feed roller pair 154 and rotating the guide member 153. Therefore, in a bending step of the bending portion 150, depending on the specifications of the liquid absorbent Po to be manufactured, it is possible to select a case where the first region P1 is bent, a case where the second region P2 is bent, or a case where any position is bent according to any size.

The bending of the fiber web Pw is not limited to a method using the folding roller pair described above. For example, a method such as bending by pressing a bending die against the fiber web Pw may be used.

In addition, the fiber structure manufacturing apparatus 1 may be provided with a bending mechanism separately from the fiber structure manufacturing apparatus 1 without the bending portion 150, so that the liquid absorbent Po may be folded.

Example 6

Figure 11:
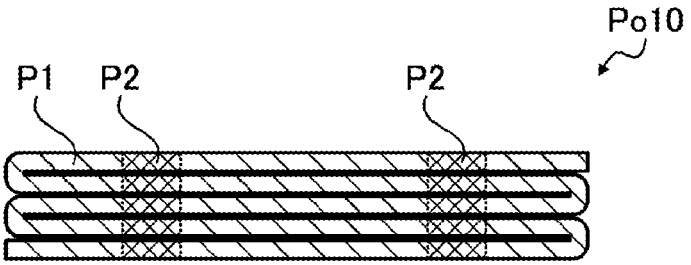
FIG. 11 is a schematic view illustrating another example of a liquid absorbent in a folded state as Example 6.

A liquid absorbent Po of the present example is an example in which the fiber web Pw is bent and provided in a folded state. The liquid absorbent Po9 illustrated in FIG. 10 and the liquid absorbent Po10 illustrated in FIG. 11 are examples of liquid absorbents formed by folding the liquid absorbent Po after cutting.

The liquid absorbent Po9 is a liquid absorbent Po having a structure in which four second regions P2 are bent and folded. In addition, since the liquid absorbent Po9 is also cut in the second region P2, all of the end portions of the liquid absorbent Po9 in the folded state include the second region P2. That is, the region having high hardness is provided at the end portion of the main surface of the liquid absorbent Po9 in the extending direction.

In addition, the liquid absorbent Po10 is a liquid absorbent Po having a structure in which four first regions P1 are bent and folded. In addition, since the liquid absorbent Po10 is also cut in the first region P1, all of the end portions of the liquid absorbent Po10 in the folded state include the first region P1. The second region P2, that is, the region having high hardness is provided between one end portion and the other end portion in the extending direction of the main surface of the liquid absorbent Po10.

According to the present embodiment, the following effects can be obtained.

The fiber structure manufacturing apparatus 1 is provided with the accumulation portion 60 that accumulates the material containing the resin and the fiber in the air to generate the fiber web Pw, the transport portion 120 that transports the generated fiber web Pw in the transport direction, and the heating and pressurizing portion 100 that pressurizes the transported fiber web Pw with the heated lower flat plate 101 and the upper flat plate 102 to melt the resin. In addition, in the fiber structure manufacturing apparatus 1, the liquid absorbent Po having the first region P1 where pressurization is performed a predetermined number of times and the second region P2 where pressurization is performed more than a predetermined number of times is formed by alternately repeating the transport at a predetermined pitch shorter than the length of the flat plate in the transport direction by the transport portion 120 and the pressurization by the heating and pressurizing portion 100. Therefore, in the liquid absorbent Po manufactured by the fiber structure manufacturing apparatus 1, the second region P2 is a region where a heat and pressure treatment is performed in an overlapping manner, and it is possible to prevent a region where is not subjected to the heat and pressure treatment from being generated. As a result, for example, the region not subjected to the heat and pressure treatment does not become a strength defect portion, and it is possible to provide a liquid absorbent Po having quality such as strength and rigidity, and for example, when the liquid absorbent Po is paper, in which quality such as paper strength is ensured.

In addition, the transport portion 120 transports the liquid absorbent Po to be manufactured by applying a transport force to the second region P2. Since the second region P2 has a larger number of pressurization than the first region P1, the resin tends to be sufficiently melted and the mechanical strength tends to be formed stronger than that of the first region P1. Since the transport portion 120 applies a transport force to the second region P2, it is possible to prevent the liquid absorbent Po from losing the shape due to the transport.

In addition, the fiber structure manufacturing apparatus 1 is provided with the cutting portion 130 for cutting the formed liquid absorbent Po, and the cutting portion 130 can cut the second region P2 of the liquid absorbent Po. Since the second region P2 has a larger number of pressurization than the first region P1, the resin tends to be sufficiently melted and the mechanical strength tends to be formed stronger than that of the first region P1. By cutting the second region P2, the cutting portion 130 can suppress the shape loss due to cutting and can provide the liquid absorbent Po with higher dimensional accuracy.

In addition, the cutting portion 130 can cut the first region P1. Since the second region P2 has a larger number of pressurization than the first region P1, the resin tends to be sufficiently melted and the mechanical strength tends to be formed stronger than that of the first region P1. By cutting the first region P1 whose mechanical strength is weaker than that of the second region P2, the cutting portion 130 can perform cutting more easily. For example, when cutting with the cutter 131, it is possible to suppress wear and breakage of the blade of the cutter 131.

In addition, the fiber structure manufacturing apparatus 1 is provided with the bending portion 150 for bending the liquid absorbent Po, and the bending portion 150 can bend the second region P2. Since the second region P2 has a larger number of pressurization than the first region P1, the resin tends to be sufficiently melted and the mechanical strength tends to be formed stronger than that of the first region P1. By bending the second region P2, the bending portion 150 is less likely to lose the shape due to bending, and can be bent with higher dimensional accuracy.

In addition, the bending portion 150 can bend the first region P1. Since the second region P2 has a larger number of pressurization than the first region P1, the resin tends to be sufficiently melted and the mechanical strength tends to be formed stronger than that of the first region P1. The bending portion 150 can be bent more easily by bending the first region P1 having a weaker mechanical strength than that of the second region P2.

A method of manufacturing a fiber structure of the present disclosure includes the accumulation step of accumulating the material containing the resin and the fiber in the air to generate the fiber web Pw, a transport step of transporting the generated fiber web Pw in the transport direction, and a heating and pressurizing step of pressurizing the transported fiber web Pw with the heated lower flat plate 101 and the upper flat plate 102 to melt the resin. In addition, in the method of manufacturing the fiber structure of the present disclosure, the liquid absorbent Po having the first region P1 where pressurization is performed a predetermined number of times and the second region P2 where pressurization is performed more than a predetermined number of times is formed by alternately repeating the transport at a predetermined pitch shorter than the length of the flat plate in the transport direction by the transport step and the pressurization by the heating and pressurizing step. Therefore, in the liquid absorbent Po manufactured by the method of manufacturing the fiber structure of the present disclosure, the second region P2 is a region where the heat and pressure treatment is performed in an overlapping manner, and it is possible to prevent a region where is not subjected to the heat and pressure treatment from being generated. As a result, for example, the region not subjected to the heat and pressure treatment does not become a strength defect portion, and it is possible to provide a liquid absorbent Po having quality such as strength and rigidity, and for example, when the liquid absorbent Po is paper, in which quality such as paper strength is ensured.

In addition, in the transport step, the transport is performed by applying a transport force to the second region P2. Since the second region P2 has a larger number of pressurization than the first region P1, the resin tends to be sufficiently melted and the mechanical strength tends to be formed stronger than that of the first region P1. In the transport step, since the transport force is applied to the second region P2, it is possible to prevent the liquid absorbent Po from losing the shape due to the transport.

In addition, the method of manufacturing the fiber structure of the present disclosure includes a cutting step of cutting the formed liquid absorbent Po, and in the cutting step, the second region P2 can be cut. Since the second region P2 has a larger number of pressurization than the first region P1, the resin tends to be sufficiently melted and the mechanical strength tends to be formed stronger than that of the first region P1. In the cutting step, since the second region P2 is cut, the shape loss due to cutting is suppressed, and the liquid absorbent Po with higher dimensional accuracy can be provided.

In addition, in the cutting step, the first region P1 can be cut. Since the second region P2 has a larger number of pressurization than the first region P1, the resin tends to be sufficiently melted and the mechanical strength tends to be formed stronger than that of the first region P1. In the cutting step, since the first region P1 having a weaker mechanical strength than that of the second region P2 is cut, the cutting can be performed more easily. For example, when cutting with the cutter 131, it is possible to suppress wear and breakage of the blade of the cutter 131.

In addition, when the method of manufacturing the fiber structure of the present disclosure includes a bending step of bending the liquid absorbent Po, in the bending step, the second region P2 can be bent. Since the second region P2 has a larger number of pressurization than the first region P1, the resin tends to be sufficiently melted and the mechanical strength tends to be formed stronger than that of the first region P1. In the bending step, since the second region P2 is bent, the shape is less likely to be lost due to bending, and the bending with higher dimensional accuracy can be performed.

In addition, in the bending step, the first region P1 can be bent. Since the second region P2 has a larger number of pressurization than the first region P1, the resin tends to be sufficiently melted and the mechanical strength tends to be formed stronger than that of the first region P1. In the bending step, since the first region P1 having a weaker mechanical strength than that of the second region P2 is bent, the bending can be performed more easily.

The fiber structure of the present disclosure is a liquid absorbent Po that has main surfaces located in a front-to-back relationship and extends along the main surface, includes the fibers and a resin that bonds the fibers over the entire extending direction of the main surface, and a region having high hardness due to the molten state of the resin when bonding the fibers is included in a plane of the main surface. Since the resin bonds the fibers over the entire extending direction of the main surface, the liquid absorbent Po is configured as a fiber structure without a strength defect portion. In addition, the liquid absorbent Po includes a region having high hardness due to the molten state of the resin when bonding the fibers. With such a configuration, in a manufacturing step of the liquid absorbent Po, a region having high hardness can be configured as an overlapping region to be melted when the resin is melted. For example, in a heat and pressure treatment for melting a resin by pressurizing with a heated flat plate, a region having high hardness can be configured as an overlapping region of the heat and pressure treatment. As a result, it is suppressed that a region not heated and pressurized, that is, a region where the resin is not melted and the fibers are not bonded is generated, for example, the region not subjected to the heat and pressure treatment does not become a strength defect portion, and there is provided a liquid absorbent Po whose quality is ensured.

In addition, the liquid absorbent Po is provided with a region having high hardness due to the molten state of the resin that bonds the fibers across the main surface of the liquid absorbent Po. With such a configuration, in the manufacturing step of the liquid absorbent Po, for example, in the heat and pressurization treatment of melting the resin by pressurizing with a heated flat plate, the flat plate can be formed into a flat plate having a length exceeding the width of the main surface, and a region having high hardness can be formed as an overlapping region where the heat and pressure treatment is performed by the flat plate. As a result, even in the width direction of the main surface, it is suppressed that a region not heated and pressed, that is, a region where the resin is not melted and the fibers are not bonded is generated, for example, the region not subjected to the heat and pressure treatment does not become a strength defect portion, and it is provided as a liquid absorbent Po whose quality is ensured.

In addition, in the liquid absorbent Po, the region having high hardness due to the molten state of the resin that bonds the fibers is provided at the end portion of the main surface of the liquid absorbent Po in the extending direction. With such a configuration, the mechanical strength of the end portion of the liquid absorbent Po can be increased, and it is provided as a liquid absorbent Po that does not easily lose the shape.

In addition, in the liquid absorbent Po, a region having high hardness is provided between one end portion and the other end portion in the extending direction of the main surface. With such a configuration, one end portion and the other end portion of the liquid absorbent Po can be configured as a region having a lower hardness than a region having a high hardness provided therebetween. As a result, for example, when the liquid absorbent Po is manufactured as an individual cut from a continuous long body, since it is possible to cut in a region having a lower hardness, cutting can be easily performed. For example, when cutting with the cutter 131, it is possible to suppress wear and breakage of the blade of the cutter 131. That is, it is provided as a liquid absorbent Po that is easy to manufacture or has a lower manufacturing cost.

The fiber structure manufacturing apparatus is not limited to the configuration of the fiber structure manufacturing apparatus 1 illustrated in FIG. 1. For example, as in a fiber structure manufacturing apparatus 1A illustrated in FIG. 12, the configuration may not be provided with the classification portion 40.

The fiber structure manufacturing apparatus 1A is provided with a transport pipe 34A that coupled to the defibration portion 30 and the accumulation portion 60 instead of the transport pipe 34 and the transport pipe 46, and the hopper 51 included in the additive input portion 50 communicates with the transport pipe 34A.

Figure 12:
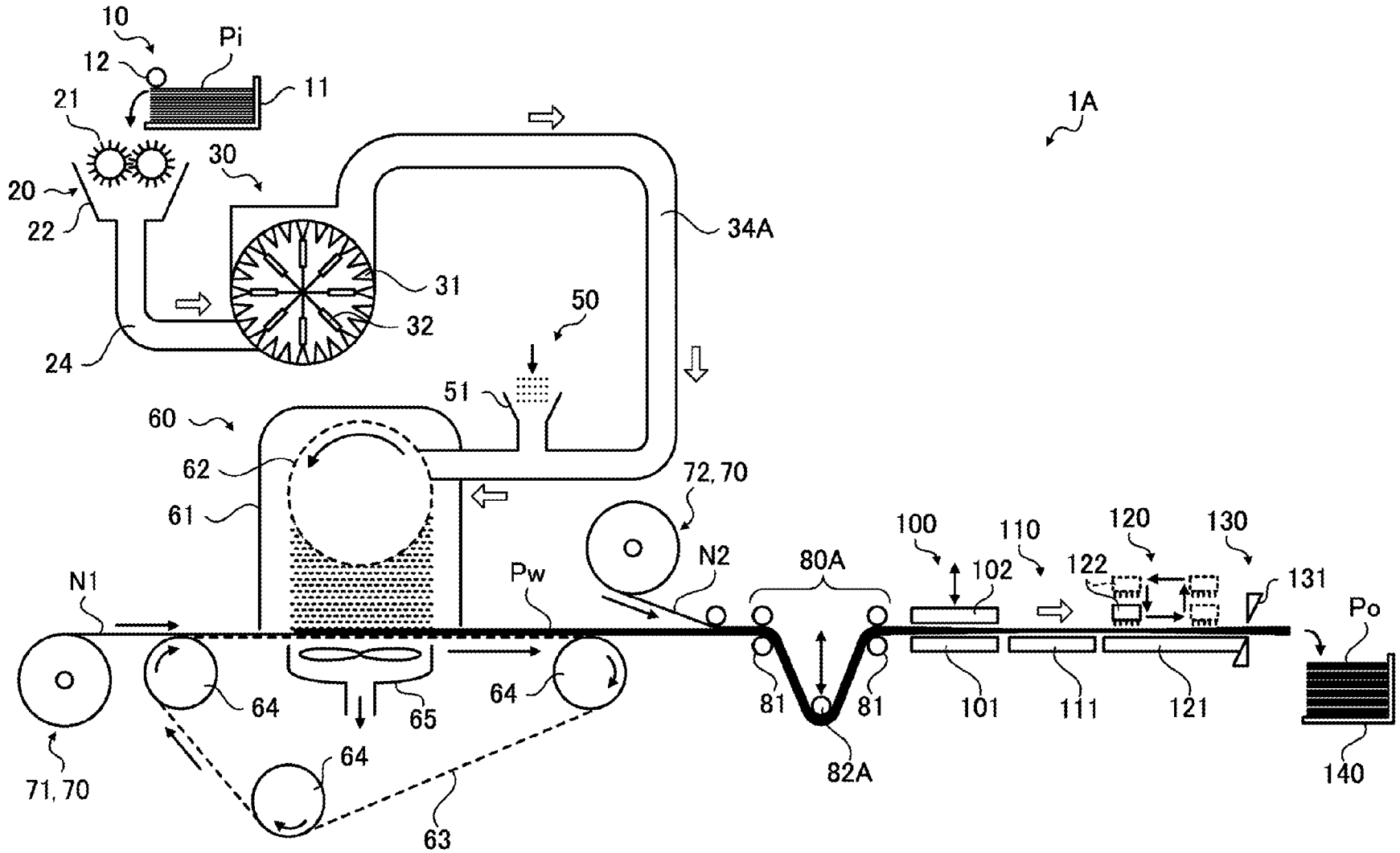
FIG. 12 is a schematic view illustrating an overall configuration of other embodiments of a fiber structure manufacturing apparatus.

In addition, the configuration of the buffer portion provided in the fiber structure manufacturing apparatus may be upside down from that of the buffer portion 80, as in a buffer portion 80A illustrated in FIG. 12.

The buffer portion 80A includes a roller 82A that moves up and down in accordance with the transport of the fiber web Pw while pressing the fiber web Pw from above in the space between the two roller pairs 81. The vertical movement of the roller 82A is controlled so that the tension applied to the fiber web Pw does not fluctuate significantly between the continuous transport of the fiber web Pw by the rotation of the mesh belt 63 and the intermittent transport of the fiber web Pw after the heating and pressurizing portion 100.

What is claimed is:

1. A method of manufacturing a fiber structure, comprising:

an accumulation step of accumulating a material containing a resin and a fiber in air to generate a fiber web;

a transport step of transporting the generated fiber web in a transport direction; and a heating and pressurizing step of pressurizing the transported fiber web with a heated flat plate to melt the resin, wherein a fiber structure having a first region where pressurization by a heating and pressurizing step is performed a predetermined number of times and a second region where the pressurization is performed more than the predetermined number of times is formed by alternately repeating transport at a predetermined pitch shorter than a length of the flat plate in the transport direction by a transport step and the pressurization.

2. The method of manufacturing a fiber structure according to claim 1, wherein in the transport step, the transport is performed by applying a transport force to the second region.

3. The method of manufacturing a fiber structure according to claim 1, further comprising:

a cutting step of cutting the formed fiber structure, wherein in the cutting step, the second region is cut.

4. The method of manufacturing a fiber structure according to claim 1, further comprising:

a cutting step of cutting the formed fiber structure, wherein in the cutting step, the first region is cut.

5. The method of manufacturing a fiber structure according to claim 1, further comprising:

a bending step of bending the formed fiber structure, wherein in the bending step, the second region is bent.

6. The method of manufacturing a fiber structure according to claim 1, further comprising:

a bending step of bending the formed fiber structure, wherein in the bending step, the first region is bent.

* * * * *